US007777690B2

(12) United States Patent
Winsor

(10) Patent No.: US 7,777,690 B2
(45) **Date of Patent: *Aug. 17, 2010**

(54) RADIO FREQUENCY LENS AND METHOD OF SUPPRESSING SIDE-LOBES

(75) Inventor: Robert Scott Winsor, Round Hill, VA (US)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 700 days.

This patent is subject to a terminal disclaimer.

(21) Appl. No.: 11/693,817

(22) Filed: Mar. 30, 2007

(65) Prior Publication Data

US 2008/0238810 A1 Oct. 2, 2008

(51) Int. Cl.
*H01Q 15/02* (2006.01)

(52) U.S. Cl. ..... 343/911 R

(58) Field of Classification Search ..... 343/909, 343/754, 911 R; 359/321; 298/322
See application file for complete search history.

(56) References Cited

U.S. PATENT DOCUMENTS

| | | | | |
|---|---|---|---|---|
| 3,226,721 | A | 12/1965 | Gould | |
| 4,080,605 | A | 3/1978 | Hilton | |
| 4,480,254 | A | 10/1984 | Spencer et al. | |
| 5,315,436 | A | 5/1994 | Lowenhar et al. | |
| 5,541,613 | A | 7/1996 | Lam et al. | |
| 5,623,360 | A | 4/1997 | Gesell et al. | |
| 5,677,796 | A | 10/1997 | Zimmerman et al. | |
| 5,689,275 | A | 11/1997 | Moore et al. | |
| 5,724,164 | A | 3/1998 | Lowenhar et al. | |
| 5,739,796 | A * | 4/1998 | Jasper et al. | 343/895 |
| 5,796,474 | A | 8/1998 | Squire et al. | |
| 6,344,937 | B1 * | 2/2002 | Sparrold et al. | 359/837 |

(Continued)

FOREIGN PATENT DOCUMENTS

DE 3326233 A1 2/1985

(Continued)

OTHER PUBLICATIONS

H.D. Griffiths and M.R. Khan, Antenna beam steering technique using dielectric wedges, IEE Proceedings, vol. 136, Pt. H, No. 2, Apr. 1989.

(Continued)

*Primary Examiner*—Huedung Mancuso
(74) *Attorney, Agent, or Firm*—Edell, Shapiro & Finnan, LLC

(57) ABSTRACT

An RF lens according to the present invention embodiments collimates an RF beam by refracting the beam into a beam profile that is diffraction-limited. The lens is constructed of a lightweight mechanical arrangement of two or more materials, where the materials are arranged to form a photonic crystal structure (e.g., a series of holes defined within a parent material). The lens includes impedance matching layers, while an absorptive or apodizing mask is applied to the lens to create a specific energy profile across the lens. The impedance matching layers and apodizing mask similarly include a photonic crystal structure. The energy profile function across the lens aperture is continuous, while the derivatives of the energy distribution function are similarly continuous. This lens arrangement produces a substantial reduction in the amount of energy that is transmitted in the side-lobes of an RF system.

28 Claims, 12 Drawing Sheets

U.S. PATENT DOCUMENTS

| | | | | |
|---|---|---|---|---|
| 6,359,681 | B1 | 3/2002 | Housand et al. | |
| 6,538,621 | B1 | 3/2003 | Sievenpiper et al. | |
| 6,549,700 | B1 | 4/2003 | Sweatt et al. | |
| 6,812,903 | B1 | 11/2004 | Sievenpiper et al. | |
| 6,859,304 | B2 | 2/2005 | Miller et al. | |
| 6,968,096 | B2 * | 11/2005 | Kittaka et al. | 385/10 |
| 7,079,730 | B2 | 7/2006 | Fallahi et al. | |
| 7,187,491 | B1 * | 3/2007 | Bratkovski | 359/321 |
| 7,239,463 | B2 | 7/2007 | Braun et al. | |
| 7,339,539 | B2 * | 3/2008 | Joannopoulos et al. | 343/754 |
| 7,463,214 | B2 | 12/2008 | Winsor et al. | |
| 7,642,978 | B2 | 1/2010 | Braunstein et al. | |
| 2002/0084869 | A1 | 7/2002 | White | |
| 2005/0195505 | A1 | 9/2005 | Braun et al. | |
| 2005/0213964 | A1 | 9/2005 | Kreger et al. | |
| 2006/0125713 | A1 * | 6/2006 | Thevenot et al. | 343/909 |
| 2006/0202909 | A1 | 9/2006 | Nagai | |
| 2006/0249804 | A1 | 11/2006 | Mouli | |
| 2008/0291101 | A1 | 11/2008 | Braunstein et al. | |

FOREIGN PATENT DOCUMENTS

| | | | |
|---|---|---|---|
| DE | 19955205 | A1 | 5/2001 |
| EP | 814344 | A2 | 12/1997 |

OTHER PUBLICATIONS

Caloz, Christophe; Itoh, Tatsuo; "Electromagnetic Metamaterials: Transmission Line Theory and Microwave Applications" 2006, John Wiley and Sons.

R. Windsor, M. Braustein, Conformal Beam Steering Apparatus for Simultaneous Manipulation of Optical and Radio Frequency Signals, Proceedings of the Spie- The International Society for Optical Engineering Spie-Int. Soc. Opt. Eng. USA, vol. 6215, 62150G (2006).

P. Vodo, P.V. Parimi W.T. Lu and S. Sridhar, Microwave Photonic Crystal with Tailor-made Negative Refractive Index, Applied Physics Letter vol. 85, No. 10 (Jan. 1, 2004), pp. 1858-1860.

F. Daschner, et al. Photonic Crystals as Host Material for a New Generation of Microwave Components, Advances in Radio Science, vol. 4 (2006), pp. 17-19.

* cited by examiner

RADIO FREQUENCY LENS AND METHOD OF SUPPRESSING SIDE-LOBES

BACKGROUND OF THE INVENTION

1. Technical Field

The present invention pertains to lenses for radio frequency transmissions. In particular, the present invention pertains to a radio frequency (RF) lens that includes a photonic crystal structure and suppresses side-lobe features.

2. Discussion of Related Art

Radio frequency (RF) transmission systems generally employ dish antennas that reflect RF signals to transmit an outgoing collimated beam. However, these types of antennas tend to transmit a substantial amount of energy within side-lobes. Side-lobes are the portion of an RF beam that are dictated by diffraction as being necessary to propagate the beam from the aperture of the antenna. Typically, suppression of the side-lobe energy is problematic for RF systems that are required to be tolerant of jamming, and is critical for reducing the probability that the transmitted beam is detected (e.g., an RF beam is less likely to be detected, jammed or eavesdropped in response to suppression of the side-lobe energy).

SUMMARY OF THE INVENTION

According to present invention embodiments, an RF lens collimates an RF beam by refracting the beam into a beam profile that is diffraction-limited. The lens is constructed of a lightweight mechanical arrangement of two or more materials, where the materials are arranged to form a photonic crystal structure (e.g., a series of holes defined within a parent material). The lens includes impedance matching layers, while an absorptive or apodizing mask is applied to the lens to create a specific energy profile across the lens. The impedance matching layers and apodizing mask similarly include a photonic crystal structure. The energy profile function across the lens aperture is continuous, while the derivatives of the energy distribution function are similarly continuous. This lens arrangement produces a substantial reduction in the amount of energy that is transmitted in the side-lobes of an RF system.

The photonic crystal structure of the present invention embodiments provides several advantages. In particular, the lens structure provides for precise control of the phase error across the aperture (or phase taper at the aperture) simply by changing the spacing and size of the hole patterns. This enables the lens to be designed with diffraction-limited wavefront qualities, thereby assuring the tightest possible beams. Further, the inherent lightweight nature of the lens parent material (and holes defined therein) enables creation of an RF lens that is lighter than a corresponding solid counterpart. The structural shape of the holes enables the lens to contain greater structural integrity at the rim portions than that of a lens with similar function typically being thin at the edges. This type of thin-edge lens may droop slightly, thereby creating errors within the wavefront. Moreover, the photonic crystal structure is generally flat or planar, thereby providing for simple manufacture, preferably through the use of computer-aided fabrication techniques. In addition, the photonic crystal structure effects steering of the entire RF beam without creating (or with substantially reduced) side-lobes.

The above and still further features and advantages of the present invention will become apparent upon consideration of the following detailed description of specific embodiments thereof, particularly when taken in conjunction with the accompanying drawings wherein like reference numerals in the various figures are utilized to designate like components.

DETAILED DESCRIPTION OF THE PREFERRED EMBODIMENTS

Figure 1:
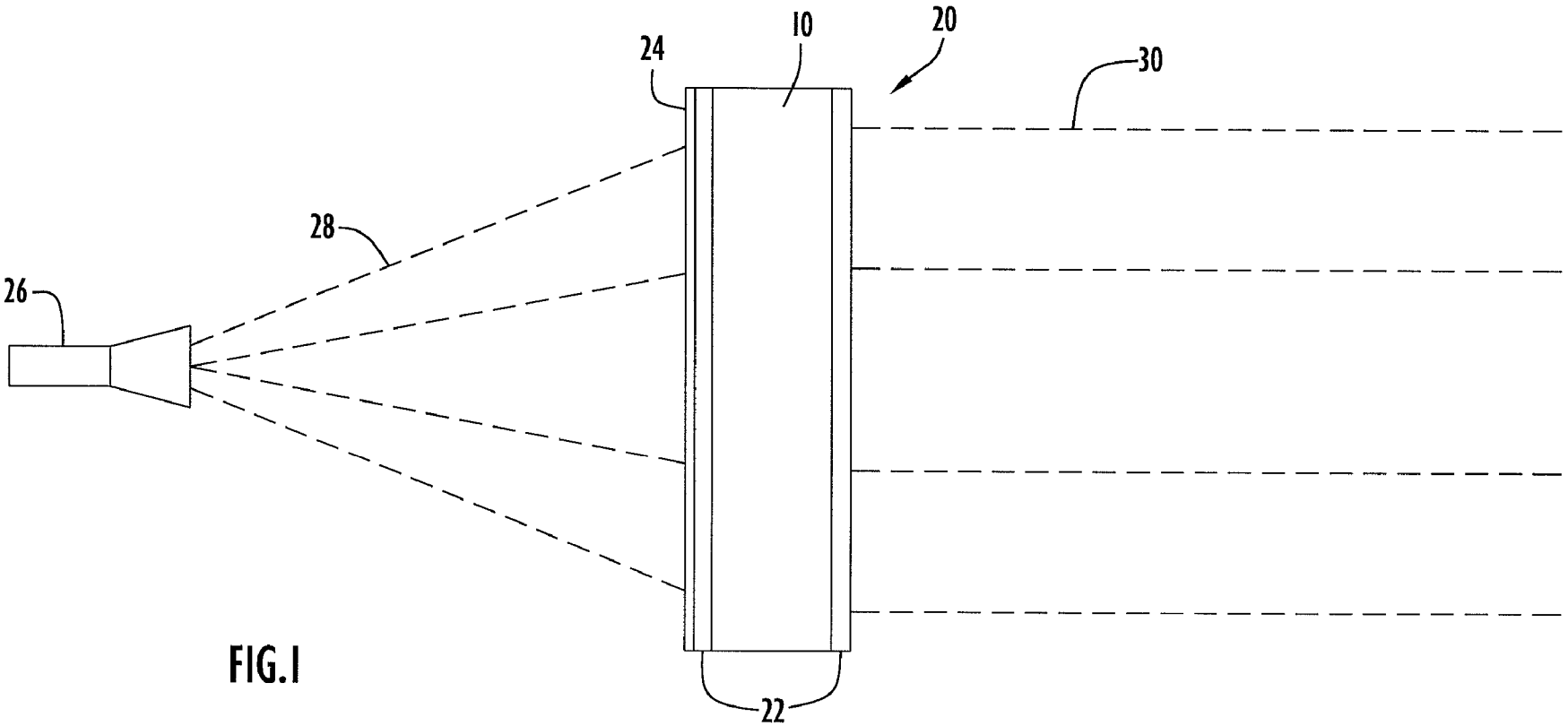
FIG. 1 is a diagrammatic illustration of an RF lens of a present invention embodiment being illuminated by an RF signal source.

The present invention embodiments pertain to a radio frequency (RF) lens that includes a photonic crystal structure and suppresses side-lobe features. An exemplary lens according to an embodiment of the present invention being illuminated by an RF signal source or feed horn is illustrated in FIG. 1. Specifically, the configuration includes a signal source 26 and an RF lens 20 according to an embodiment of the present invention. Signal source 26 may be implemented by any conventional or other signal source (e.g., feed horn, antenna, etc.) and preferably provides an RF signal or beam 28. Lens 20 receives the RF beam from signal source 26 and refracts the beam to produce a collimated RF beam 30. Lens 20 may be utilized for any suitable RF transmission and/or reception system.

Lens 20 includes a lens portion or layer 10, a plurality of impedance matching layers 22 and an absorption or apodizing layer or mask 24. Lens layer 10 is disposed between and attached to impedance matching layers 22. Absorption layer 24 is attached to the impedance matching layer facing signal source 26, where RF beam 28 enters lens 20 and traverses absorption layer 24, impedance matching layer 22 and lens layer 10, and exits through the remaining impedance matching layer as a collimated beam. However, the layers of lens 20 may be of any quantity, shape or size, may be arranged in any suitable fashion and may be attached by any conventional or other suitable techniques (e.g., adhesives, etc.).

Figure 2A:
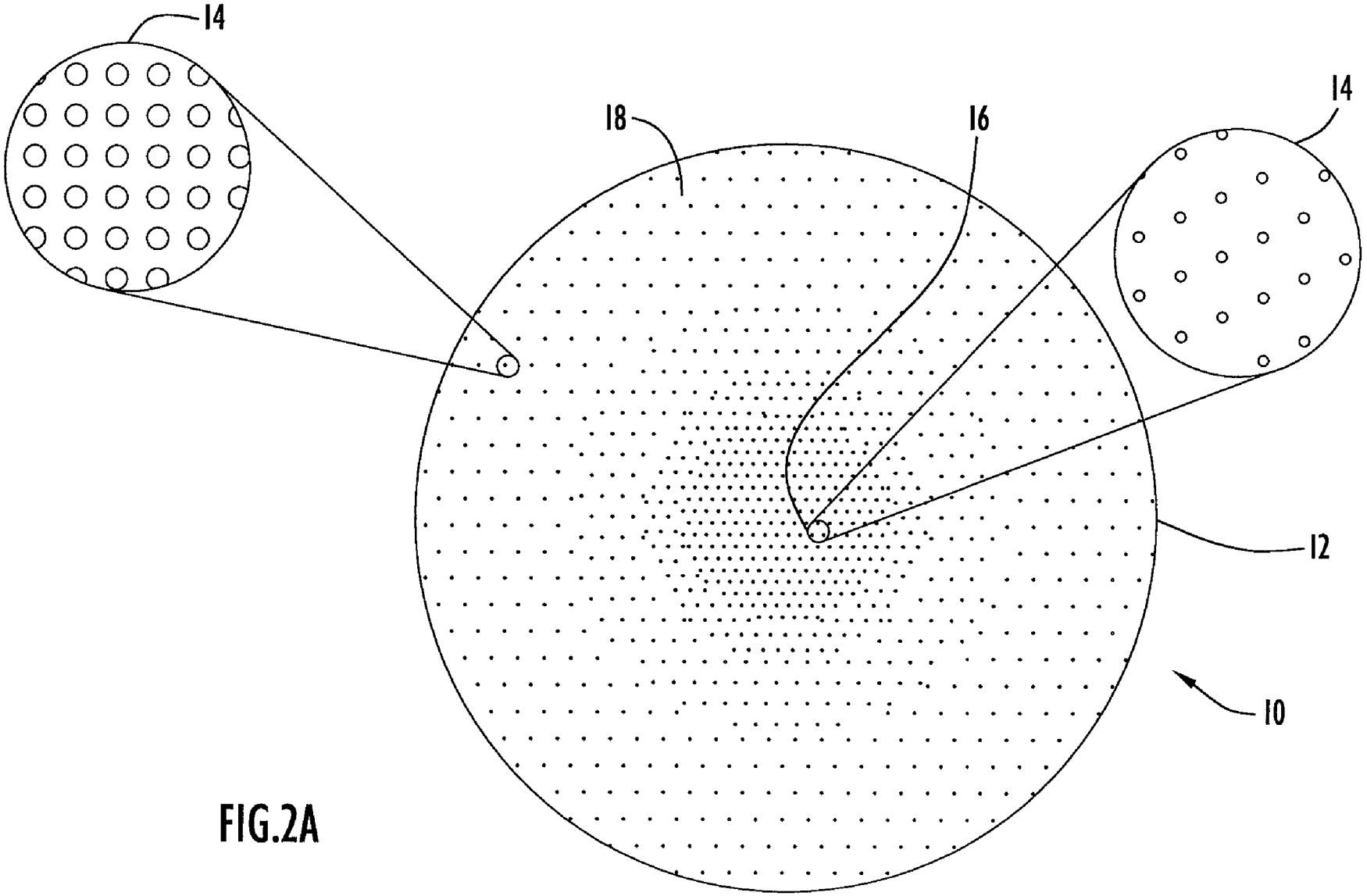
FIGS. 2A-2C are views in elevation of exemplary photonic crystal structures of the type employed by the lens of the present invention embodiments.

Lens layer 10 includes a photonic crystal structure. An exemplary photonic crystal structure for lens layer 10 is illustrated in FIG. 2A. Initially, photonic crystal structures utilize various materials, where the characteristic dimensions of, and spacing between, the materials are typically on the order of, or less than, the wavelength of a signal (or photon) of interest (e.g., for which the material is designed). The materials typically include varying dielectric constants. Photonic crystal structures may be engineered to include size, weight and shape characteristics that are desirable for certain applications. Specifically, lens layer 10 is formed by defining a series of holes 14 within a parent material 12, preferably by drilling techniques. However, the holes may alternatively be defined within the parent material via any conventional techniques or machines (e.g., computer-aided fabrication, two-dimensional machines, water jet cutting, laser cutting, etc.). In this case, the two materials that construct the photonic crystal structure include air (or possibly vacuum for space applications) and parent material 12. The parent material is preferably an RF laminate and includes a high dielectric constant (e.g., in the range of 10-12). The parent material may alternatively include plastics, a high density polyethylene, glass or other materials with a low loss tangent at the frequency range of interest and a suitable dielectric constant. The hole arrangement may be adjusted to alter the behavior of the lens layer as described below.

Parent material 12 may be of any suitable shape or size. By way of example only, parent material 12 is substantially cylindrical in the form of a disk and includes an inner region 16 disposed near the disk center and an outer region 18 disposed toward the disk periphery. Holes 14 are defined within inner and outer regions 16, 18. The holes are generally defined through the parent material in the direction of (or substantially parallel to) the propagation path of the beam (e.g., along a propagation axis, or from the lens front surface through the lens thickness toward the lens rear surface). Holes 14 within outer region 18 include dimensions less than that of the wavelength of the signal or beam of interest, while the spacing between those holes are similarly on the order of or less than the interested signal wavelength. For example, a hole dimension and spacing each less than one centimeter may be employed for an RF beam with a frequency of 30 gigahertz (GHz). A greater efficiency of the lens may be achieved by reducing the dimensions and spacing of the holes relative to the wavelength of the signal of interest as described below.

As a photon approaches material 12, an electromagnetic field proximate the material essentially experiences an averaging effect from the varying dielectric constants of the two materials (e.g., material 12 and air) and the resulting dielectric effects from those materials are proportional to the average of the volumetric capacities of the materials within the lens layer. In other words, the resulting dielectric effects are comparable to those of a dielectric with a constant derived from a weighted average of the material constants, where the material constants are weighted based on the percentage of the corresponding material volumetric capacity relative to the volume of the structure. For example, a structure including 60% by volume of a material with a dielectric constant of 11.0 and 40% by volume of a material with a dielectric constant 6.0 provides properties of a dielectric with a constant of 9.0 (e.g., (60%×11.0)+(40%×6.0)=6.6+2.4=9.0).

Since an optical lens includes greater refractive material near the lens center portion than that near the lens edge, the photonic crystal structure for lens layer 10 is constructed to similarly include (or emulate) this property. Accordingly, holes 14 defined within outer region 18 are spaced significantly closer together than holes 14 defined within inner region 16. The spacing of holes 14 and their corresponding diameters may be adjusted as a function of the structure radius to create a lens effect from the entire structure. Thus, the electromagnetic fields produced by the photonic crystal structure essentially emulate the effects of the optical lens and enable the entire beam to be steered or refracted. Since the photonic crystal structure is generally planar or flat, the photonic crystal structure is simple to manufacture and may be realized through the use of computer-aided fabrication techniques as described above.

Figure 3A:
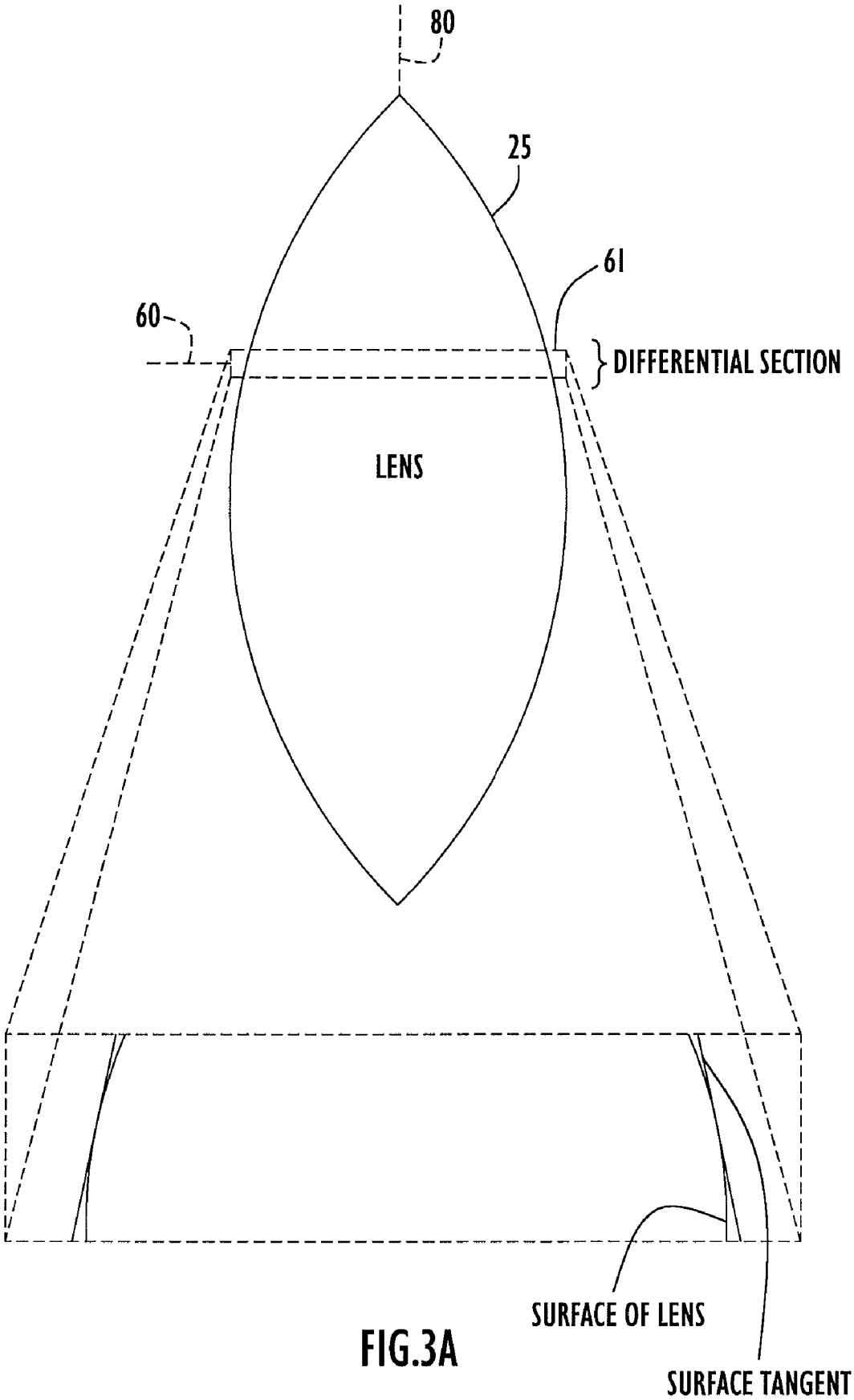
FIG. 3A is a side view in elevation of an exemplary optical lens.
Figure 3B:
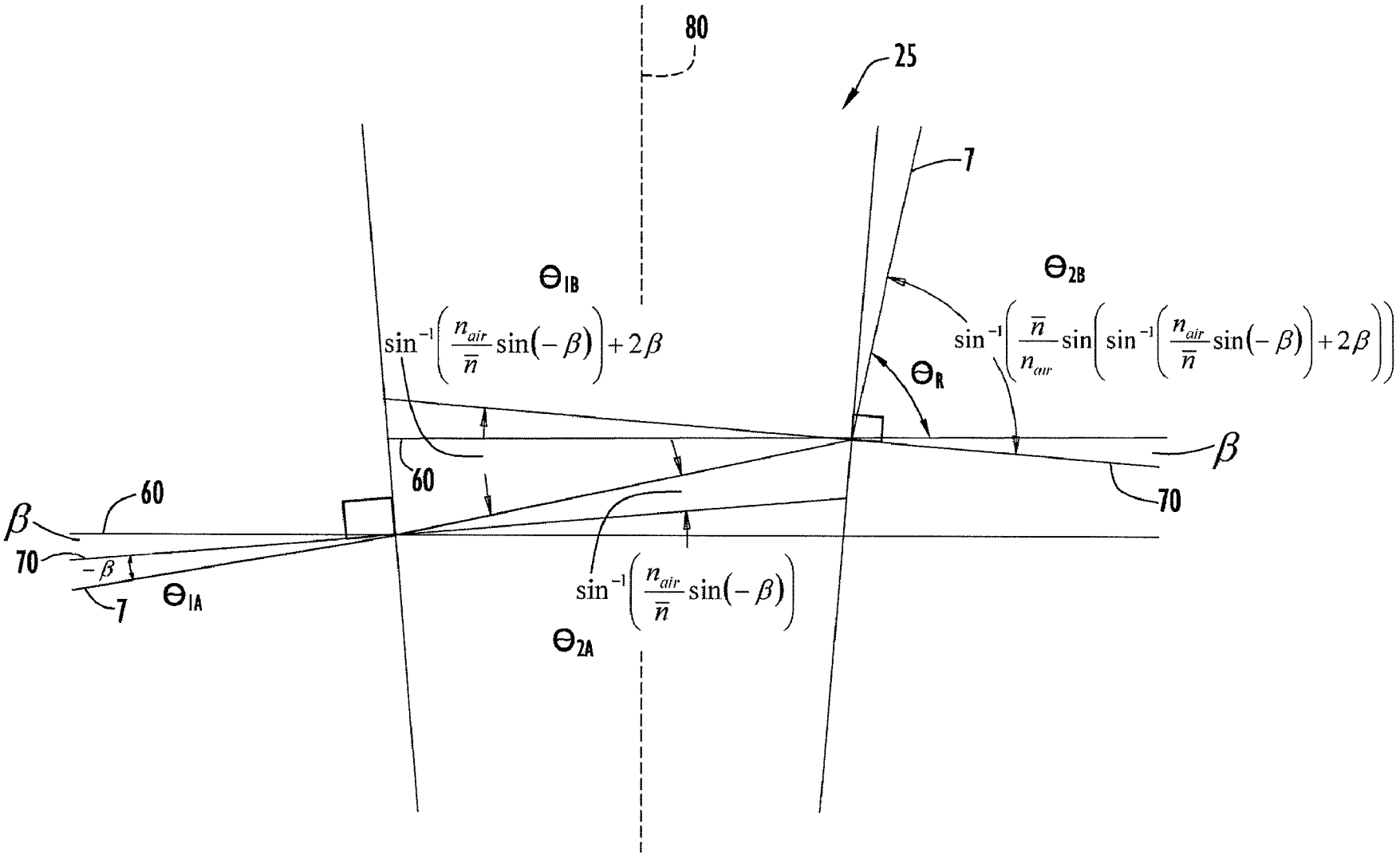
FIG. 3B is a diagrammatic illustration of a beam being steered by a lower potion of the lens of FIG. 3A.
Figure 4:
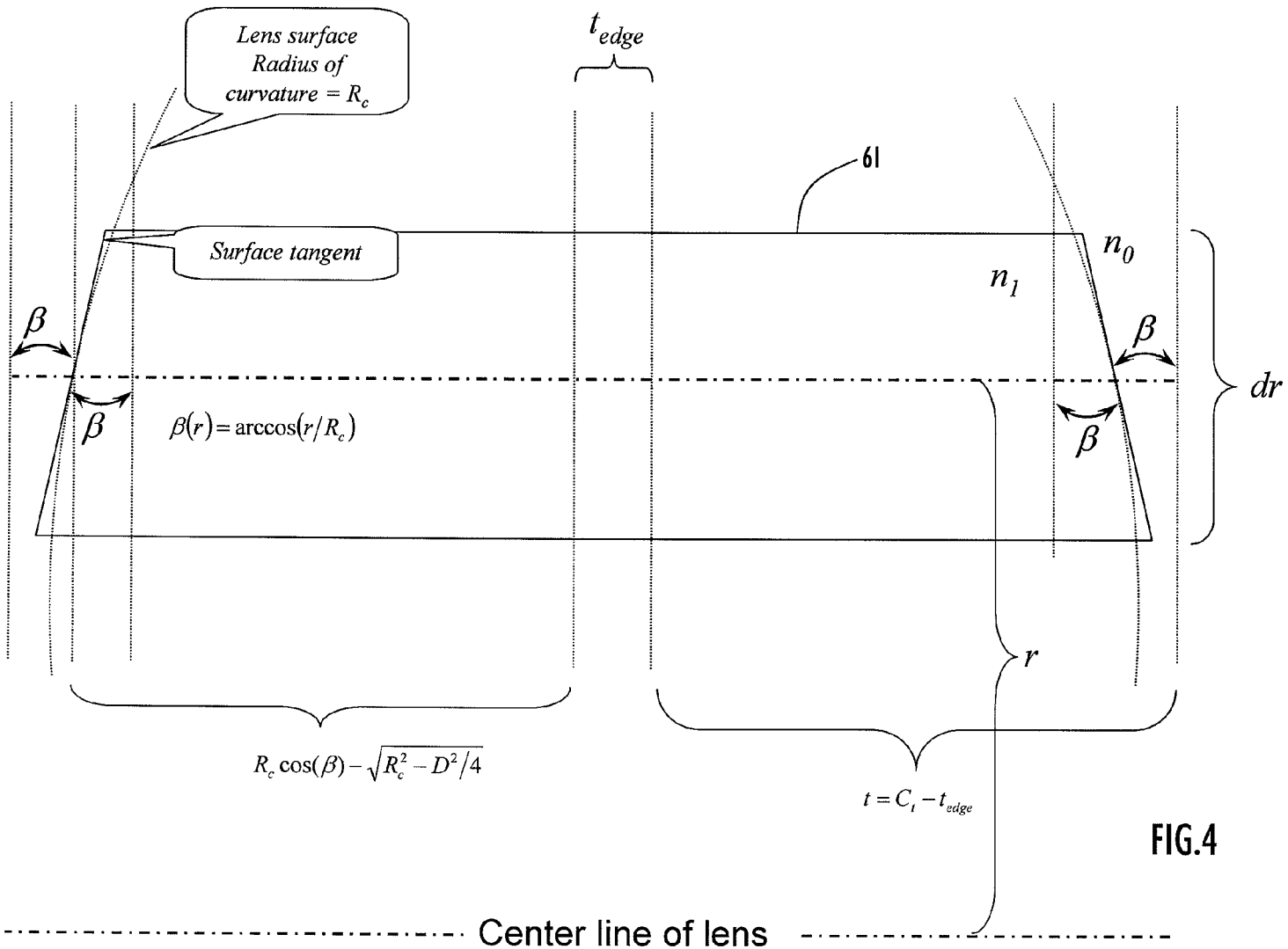
FIG. 4 is a side view in elevation of a portion of the lens of FIG. 3A.

The manner in which holes 14 are defined in lens layer 10 is based on the desired steering or refraction of the RF beam. An exemplary optical lens 25 that steers or refracts a beam is illustrated in FIGS. 3A-3B and 4. Initially, lens 25 is substantially circular and includes generally curved or spherical surfaces or faces. The lens may be considered as a plurality of differential sections 61 for purposes of describing the steering effect. Each differential section 61 of lens 25 (FIG. 3A) includes a generally trapezoidal cross-section and steers a beam as if the lens was actually a wedge prism, where an equivalent wedge angle for that section is a function of the distance of the differential section from the lens center (e.g., the wedge angle is measured relative to a surface tangent for the lens curved surfaces). In other words, a beam is refracted according to a lens local surface gradient in a manner substantially similar to refraction from a planar surface.

Specifically, a beam 7 is directed to traverse lens 25. The propagation of the beam exiting the lens may be determined from Snell's Law as follows.

$$n_1 \sin \theta_1 = n_2 \sin \theta_2 \qquad \text{(Equation 1)}$$

where $n_1$ is the index of refraction of the first material traversed by the beam, $n_2$ is the index of refraction of the second material traversed by the beam, $\theta_1$ is the angle of the beam entering into the second material, and $\theta_2$ is the angle of the refracted beam within that material. The steering angles of interest for beam 7 directed toward lens 25 are determined relative to propagation axis 60 (e.g., an axis perpendicular to and extending through the lens front and rear faces) and in accordance with Snell's Law. Thus, each of the equations based on Snell's Law (e.g., as viewed in FIG. 3B) has the equation angles adjusted by the wedge angle (e.g., $\beta$ as viewed in FIG. 3B) to attain the beam steering value relative to the propagation axis as described below.

Beam 7 enters lens 25 at an angle, $\theta_{1A}$, that is within a plane containing optical axis 80 for the lens (e.g., the vertical line or axis through the center of the lens from the thinnest part to the thickest part) and lens propagation axis 60. This angle is the angle of the beam entry. Since lens 25 changes the refraction as a function of the radius from the lens center, a beam is normal to the particular point upon which the beam impinges. Accordingly, the angle of beam entry beam, $\theta_{1A}$, relative to propagation axis 60 is simply the wedge angle, $\beta$, of the lens (e.g., $\theta_{1A}=-\beta$ as viewed in FIG. 3B). The beam is refracted at an angle, $\theta_{2A}$, relative to surface normal 70 of the lens front surface and determined based on Snell's Law as follows.

$$\theta_{2A} = \left(\sin^{-1}\left(\frac{n_{air}}{\bar{n}}\sin(\theta_{1A})\right)\right) \qquad \text{(Equation 2)}$$

where $n_{air}$ is the index of refraction of air, $\bar{n}$ is the average index of refraction of the lens material at the radial location of impact described below and $\theta_{1A}$ is the angle of beam entry.

The beam traverses the lens and is directed toward the lens rear surface at an angle, $\theta_{1B}$, relative to surface normal 70 of that rear surface. This angle is the angle of refraction by the lens front surface, $\theta_{2A}$, combined with wedge angles, $\beta$, from the front and rear lens surfaces and may be expressed as follows.

$$\theta_{1B}=\theta_{2A}+2\beta \qquad \text{(Equation 3)}$$

The beam traverses the lens rear surface and is refracted at an angle, $\theta_{2B}$, relative to surface normal 70 of the lens rear surface and determined based on Snell's Law as follows.

$$\theta_{2B} = \left(\sin^{-1}\left(\frac{\bar{n}}{n_{air}}\sin(\theta_{1B})\right)\right) \quad \text{(Equation 4)}$$

where $\bar{n}$ is the average index of refraction of the lens material at the radial location of impact described below, $n_{air}$ is the index of refraction of air, and $\theta_{1B}$ is the angle of beam entry. The angle of refraction, $\theta_R$, relative to propagation axis 60 is simply the refracted angle relative to surface normal 70 of the lens rear surface, $\theta_{2B}$, less the wedge angle, β, of the lens rear surface (e.g., as viewed in FIG. 3B) and may be expressed as follows.

$$\theta_R = \theta_{2B} - \beta \quad \text{(Equation 5)}$$

$$= \sin^{-1}\left(\frac{\bar{n}}{n_{air}}\sin\left(\sin^{-1}\left(\frac{n_{air}}{n_M}\sin(-\beta)\right) + 2\beta\right)\right) - \beta$$

Referring to FIG. 4, the transverse cross-section of a differential section 61 of exemplary optical lens 25 is symmetric about a plane perpendicular to propagation axis 60. The lens typically includes a nominal thickness, $t_{edge}$, at the lens periphery. The lens material includes an index of refraction, $n_1$, while the surrounding media (e.g., air) includes an index of refraction, $n_0$, typically approximated to 1.00. An average index of refraction for lens 25 may be determined for a differential section 61 or line (e.g., along the dashed-dotted line as viewed in FIG. 4) as a function of the distance, r, of that line from the center of lens 25 (e.g., as viewed in FIG. 4) as follows (e.g., a weighted average of index of refraction values for line segments along the line based on line segment length).

$$\bar{n}(r) = \frac{2n_1\left(r - \sqrt{R_C^2 - D^2/4}\right) + 2n_0\left(C_t - \left(r - \sqrt{R_C^2 - D^2/4}\right)\right)}{C_t - t_{edge}} \quad \text{(Equation 6)}$$

where $n_1$ is the index of refraction of lens 25, $n_0$ is the index of refraction of air, $R_C$ is the radius of curvature of the lens surface, D is the lens diameter, $C_t$ is the center thickness of the lens, $t_{edge}$ is the edge thickness of the lens and β is the wedge angle of section 61. The edge thickness, $t_{edge}$, of lens 25 does not contribute to the average index of refraction since the lens index of refraction remains relatively constant in the areas encompassed by the edge thickness (e.g., between the vertical dotted lines as viewed in FIG. 4).

The wedge angle, β, is a function of the distance, r, from the center of the lens as follows.

$$\beta(r) = \arccos(r/R_C) \quad \text{(Equation 7)}$$

where $R_C$ is the radius of curvature of the lens surface. Accordingly, the average index of refraction may be expressed as a function of the wedge angle, β, as follows.

$$\bar{n}(\beta) = \frac{2n_1\left(R_C\cos(\beta) - \sqrt{R_C^2 - D^2/4}\right) + 2n_0\left(C_t - \left(R_C\cos(\beta) - \sqrt{R_C^2 - D^2/4}\right)\right)}{C_t - t_{edge}} \quad \text{(Equation 8)}$$

where $n_1$ is the index of refraction of lens 25, $n_0$ is the index of refraction of air, $R_C$ is the radius of curvature of the lens surface, D is the lens diameter, $C_t$ is the lens center thickness, $t_{edge}$ is the lens edge thickness and β is the wedge angle of section 61. Therefore, a photonic crystal lens with a particular index of refraction profile provides the same beam steering characteristics as lens 25 (or sections 61) with wedge angles, β, derived from Equation 8.

The average index of refraction for lens 25 is a function of the radius or distance, r, from the center of the lens. This function is not a constant value, but rather, follows a function needed to accomplish the requirements of the lens. The function of an optical lens is to either focus collimated light into a feed or to re-image the energy from one feed into another. For the case of focusing collimated light, the bending of the rays follows a simple formula. A ray hitting the optical lens at a radius or distance, r, from the lens center is deflected by an angle, $\theta_L$, which is a function of the lens Focal length, $F_l$, as follows.

$$\theta_L = \arctan(r/F_l) \quad \text{(Equation 9)}$$

As described above, Equation 5 provides the angle of the steered or refracted beam, $\theta_R$, based on Snell's Law.

The properties for lens layer 10 may be obtained iteratively from the above equations, where the index of refraction for a photonic crystal structure is equivalent to the square root of the dielectric constant as described above. In particular, the process commences with a known or desired optical lens function for emulation by lens 20 (e.g., Equation 9) and the requirements or properties for the optical lens focal length. A given radial value, r, is utilized to obtain the deflection angle, $\theta_L$, from Equation 9, where the deflection angle is equated with the refraction angle, $\theta_R$, and inserted into Equation 5. Since the average index of refraction is a function of the wedge angle, β, the wedge angle and/or average index of refraction required to perform the lens function for the radial value may be determined from Equation 8. This process is performed iteratively for radial values, r, to provide an index of refraction profile for the lens (e.g., the average index of refraction for radial locations on the lens).

In order to create photonic crystal lens 20 that emulates the physical properties of lens 25, holes 14 are arranged within parent material 12 (FIG. 2A) of lens 20 to create the average index of refraction profile described above. Lens 20 typically includes substantially planar front and rear faces normal to the propagation axis (or direction of the beam propagation path) and emulates the physical properties of the optical lens via produced electromagnetic fields. However, the index of refraction for a photonic crystal lens is equivalent to the square-root of the lens dielectric constant (e.g., for materials that exhibit low loss tangents which are preferred for refracting or steering RF beams). In the case of materials including significant absorption or scatter, the index of refraction is a complex value with real and imaginary components. The imaginary component provides a measure of loss. Since the magnitude of the imaginary component (or loss) detracts from the real component (or dielectric constant), the dielectric constant differs from the above relationship in response to significant losses.

The effective index of refraction along a portion or line of the photonic crystal lens is obtained by taking the average volumetric index of refraction along that line (e.g., a weighted average of the index of refraction (or dielectric constants of the materials and holes) along the line based on volume in a manner similar to that described above). The steering angle, $\theta_R$, of the resulting photonic crystal lens may be determined based on Snell's Law by utilizing the effective index of refraction of the photonic crystal lens as the average index of refraction, $\bar{n}$, within Equation 5 described above. The volumetric average determination should consider the regions above and below the line (e.g., analogous to distance value, r, described above). The physical shape of the holes may vary depending on the manufacturing process. One exemplary manufacturing process includes drilling holes in the prism materials.

The orientation of the holes defined in the photonic crystal lens may be normal to the front and back lens faces (e.g., in a direction of the beam propagation axis or path). The dimensions of the holes are sufficiently small to enable the electromagnetic fields of photons (e.g., manipulated by the photonic crystal structure) to be influenced by the average index of refraction over the lens volume interacting with or manipulating the photons. Generally, the diameter of the holes does not exceed (e.g., less than or equal to) one-quarter of the wavelength of the beam of interest, while the spacing between the holes does not exceed (e.g., less than or equal to) the wavelength of that beam.

Accordingly, an interaction volume for the photonic crystal lens includes one square wave (e.g., an area defined by the square of the beam wavelength) as viewed normal to the propagation axis. Since changes in the photonic crystal structure may create an impedance mismatch along the propagation axis, the interaction length or thickness of the photonic crystal lens includes a short dimension. Generally, this dimension of the photonic crystal lens along the propagation axis (e.g., or thickness) should not exceed 1/16 of the beam wavelength in order to avoid impacting the propagation excessively (e.g., by producing back reflections or etalon resonances). Thus, drilling holes through the thickness of the material is beneficial since this technique ensures minimal change to the index of refraction along the propagation axis.

By way of example, a spacing of holes within the parent material that provides a minimum average index of refraction (e.g., defined by the largest hole diameter allowed and determined by the wavelength of operation as described above) includes the holes spaced apart from each other in a hexagonal arrangement of equatorial triangles (e.g., each hole at a corresponding vertex of a triangle) with a minimum wall thickness between holes to provide adequate mechanical strength. This is a spacing of holes that coincides with the thinnest part of a conventional lens.

Conversely, a spacing of holes within the parent material that may provide the greatest average index of refraction is a photonic crystal lens without the presence of holes. However, the need for a smoothly changing average index of refraction and efficient control of the direction of the beam energy may put limitations on this configuration. If the photonic crystal lens is configured to include holes of the same size (e.g., as may be economically feasible due to manufacturing limitations on machines, such as automated drilling centers), the maximum average index of refraction would be obtained with a minimum of one hole per interaction volume. This region of the photonic crystal lens corresponds to the thickest part of lens 25.

Referring back to FIG. 1, the use of a parent material with a high dielectric constant value for lens layer 10 results in a lighter lens, but tends to produce the lens without the property of being impedance matched. The lack of impedance matching creates surface reflections and ultimately requires more power to operate an RF system. Accordingly, lens 20 includes impedance matching layers 22 applied to photonic crystal lens layer 10 to minimize these reflections. The ideal dielectric constant of impedance matching layers 22 is the square-root of the dielectric constant of lens layer 10. However, due to the variable hole spacing in the lens layer (e.g., within inner and outer regions 16, 18) as described above, the dielectric constant for the lens layer is variable.

Figure 2B:
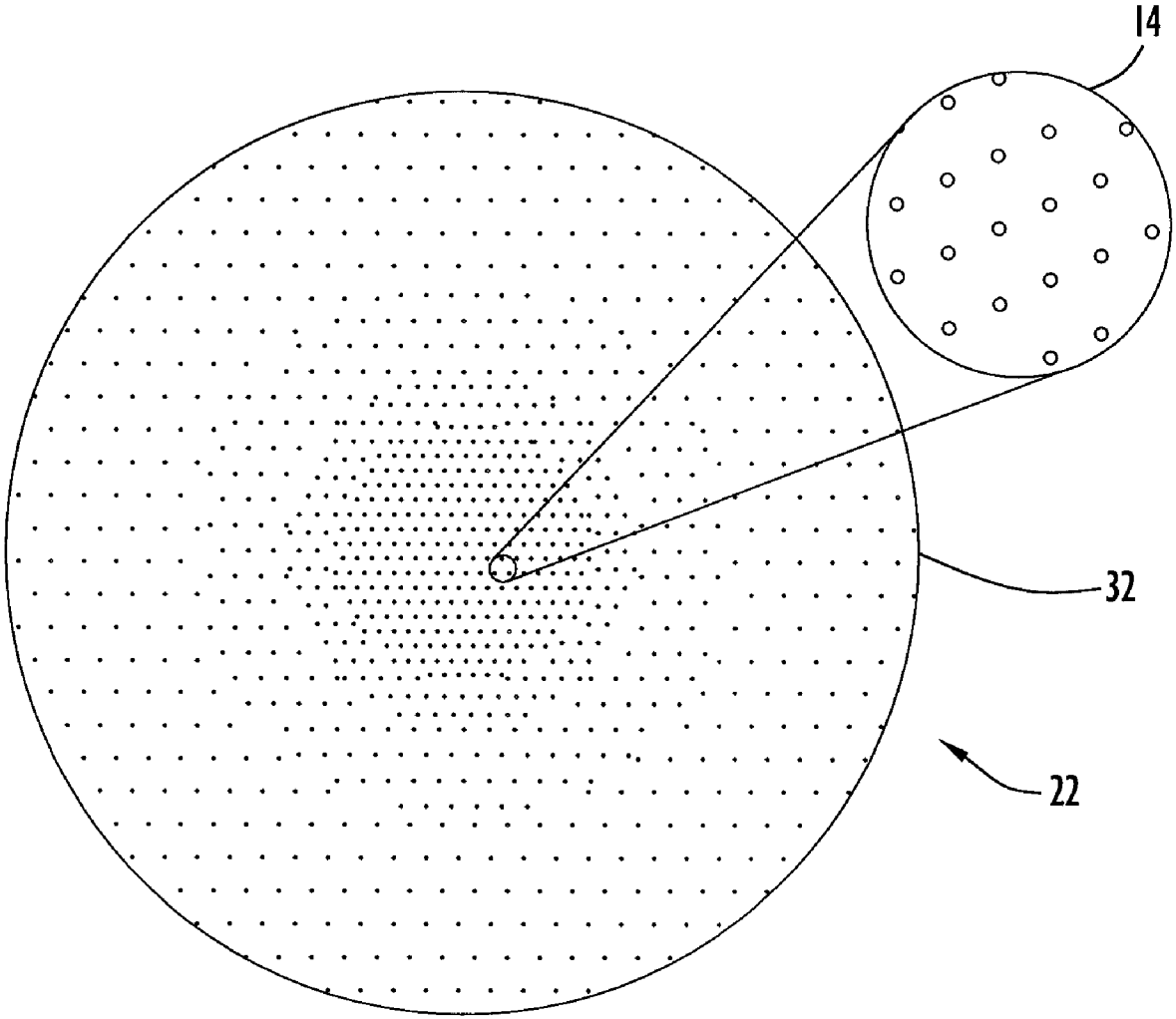

In order to compensate for the variable dielectric constant of the lens layer, impedance matching layers 22 similarly include a photonic crystal structure (FIG. 2B). This structure may be constructed in the manner described above for the lens layer and includes a parent material 32 with an average dielectric constant approximating the square-root of the average dielectric constant of parent material 12 used for lens layer 10. The parent material may be of any shape or size and may be of any suitable materials including the desired dielectric constant properties. By way of example only, parent material 32 is substantially cylindrical in the form of a disk with substantially planar front and rear surfaces.

Impedance matching layers 22 typically include a hole-spacing pattern similar to that for lens layer 10, but with minor variations to assure a correct square-root relationship between the local average dielectric constant of the lens layer and the corresponding local average dielectric constant of the impedance matching layers. In other words, the hole-spacing pattern is arranged to provide an average index of refraction (e.g., Equation 6) (or dielectric constant) profile equivalent to the square root of the index of refraction (or dielectric constant) profile of the layer (e.g., lens layer 10) being impedance matched. In particular, the impedance matching layer thickness is in integer increments of $(2n-\lambda)/4$ waves or wavelength (e.g., 1/4 wave, 3/4 wave, 5/4 wave, etc.) and is proportional to the square-root of the average index of refraction of the lens layer being impedance matched as follows.

$$t\sqrt{\bar{n}(r)}=(2n-1)\lambda/4 \qquad \text{(Equation 10)}$$

where t is the impedance layer thickness, $\lambda$ is the wavelength of the beam of interest, n represents a series instance and $\bar{n}(r)$ is the average index of refraction of the lens layer as a function of the distance, r, from the lens center.

Achieving a lower index of refraction with an impedance matching layer may become infeasible due to the quantity of holes required in the material. Accordingly, systems requiring impedance matching layers should start with an analysis of the minimum average index of refraction that is likely to be needed for mechanical integrity, thereby providing the index of refraction required for the impedance matching layer. The average index of refraction of the device to which this impedance matching layer is mated would consequently be the square of the value achieved for the impedance matching layer.

An ideal thickness for the impedance matching layers is one quarter of the wavelength of the signal of interest divided by the square-root of the (average) index of refraction of the impedance matching layer (e.g., Equation 10, where the index of refraction is the square root of the dielectric constant as described above). Due to the variability of the dielectric constant (e.g., as a function of radius) of the impedance matching layer, a secondary machining operation may be utilized to apply curvature to the impedance matching layers and maintain one quarter wave thickness from the layer center to the layer edge. The impedance matching layers may enhance antenna efficiency on the order of 20% (e.g., from 55% to 75%).

A typical illumination pattern on a dish antenna is a truncated exponential field strength, or a truncated Gaussian. The Gaussian is truncated at the edge of the dish antenna since the field must get cut-off at some point. At the edge of the dish antenna, the field strength must go to zero, yet for a typical feed horn arrangement, the field strength at the edge of the dish antenna is greater than zero. This creates a problem in the far field, where the discontinuous derivative of the aperture illumination function creates unnecessarily strong side-lobes. Side-lobes are the portion of an RF beam that are dictated by diffraction as being necessary to propagate the beam from the aperture of the antenna. In the far field, the main beam follows a beam divergence that is on the order of twice the beam wavelength divided by the aperture diameter. The actual intensity pattern over the entire far field, however, is accurately approximated as the Fourier transform of the aperture illumination function.

Sharp edges in the aperture illumination function or any low order derivatives creates spatial frequencies in the far field. These spatial frequencies are realized as lower-power beams emanating from the RF antenna, and are called side-lobes. Side-lobes contribute to the detectability of an RF beam, and make the beam easier to jam or eavesdrop. In order to reduce the occurrence of these types of adverse activities, the side-lobes need to be reduced. One common technique to reduce side-lobes is to create an aperture illumination function that is continuous, where all of the function derivatives are also continuous. An example of such an illumination function is a sine-squared function. The center of the aperture includes an arbitrary intensity of unity, while the intensity attenuates following a sine-squared function of the aperture radius toward the outer aperture edge, where the intensity equals zero.

The sine-squared function is a simple function that clearly has continuous derivatives. However, other functions can be used, and may offer other advantages. In any event, the illumination function should be chosen to include some level of absorption of the characteristic feed horn illumination pattern (e.g., otherwise, gain would be required).

Another common technique to reduce the illumination function at the antenna edge is to configure the edge of a reflective antenna with a series of pointed triangles (e.g., a serrated edge). This provides a tapered reflection profile and smoothly brings the aperture illumination function to zero at the edge of the reflector, thereby assisting in the reduction of side-lobes. However, these types of structures are not feasible for lenses and may create spatial frequency effects in the far field due to their physical dimensions typically being greater than the wavelength of the signal of interest.

Figure 2C:
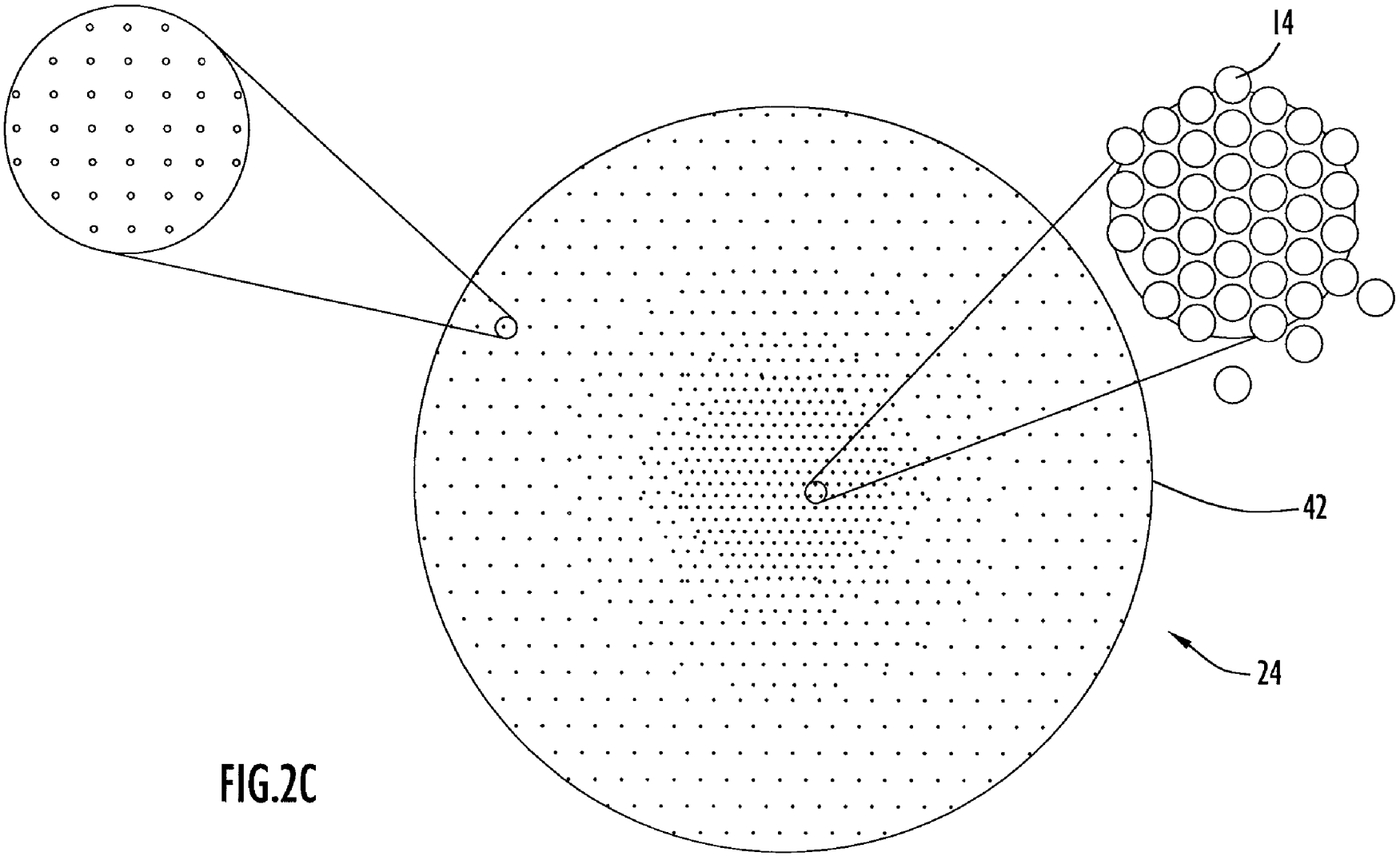

In order to reduce side-lobes, lens 20 includes apodizing mask 24 that is truly absorptive for an ideal case. If the attenuation of the illumination pattern occurs through the use of reflective techniques (e.g., metal coatings), care must be exercised to control the direction of those reflections. The apodizing mask is preferably constructed to include a photonic crystal structure (FIG. 2C) similar to the photonic crystal structures described above for the lens and impedance matching layers. In particular, holes 14 may be defined within a parent material 42 with an appropriate absorption coefficient via any suitable techniques (e.g., drilling, etc.). The holes are arranged or defined within the parent material to provide the precise absorption profile desired. The parent material may be of any shape or size and may be of any suitable materials including the desired absorbing properties. By way of example only, parent material 42 is substantially cylindrical in the form of a disk with substantially planar front and rear surfaces.

Material absorption is analyzed to provide the needed absorption profile as a function of lens radius (as opposed to the index of refraction). Holes 14 are placed in parent absorber material 42 to create an average absorption over a volume in substantially the same manner described above for achieving the average index of refraction profile for the lens layer. The actual function of the apodization profile may be quite complex if a precise beam shape is required. However, a simple formula applied at the edge of the aperture is sufficient to achieve a notable benefit.

An example of an apodizing function that may approximate a desired edge illumination taper for controlling side-lobes is one that includes a $1/r^2$ function, where r represents the radius or distance from the lens center. For example, a lens with an incident aperture illumination function that is Gaussian in profile and an edge intensity of 20% (of the peak intensity at the center) may be associated with an edge taper function, $\psi(r)$, as follows.

$$\psi(r) = \left(\frac{1}{3(1-r)}\right)^2 + 1 \qquad \text{(Equation 11)}$$

The denominator multiplier term (e.g., three) is a consequence of the illumination function including 20% energy at the edge of the aperture. This multiplier may vary according to the energy value at the edge of the aperture. Equation 11 provides the absorption ratio as a function of radius, which can be summarized as the ratio of the absorbed energy over the transmitted energy. The value for the radius is normalized (e.g., radius of $r_{max}=1$) for simplicity. This function closely approximates the ideal apodization function. However, minor variations to the function may be desired for an optimized system.

In order to realize this function within photonic crystal apodizing mask 24, a series of holes 14 are placed within parent material 42 that is highly absorptive to radio waves (e.g., carbon loaded material, etc.). The average absorption of the material (e.g., a weighted average of the absorption of the material and holes (e.g., the holes should have no absorption) based on volume and determined in a manner similar to the weighted average for the dielectric constant described above) over the interaction volume of the lens provides the value of the absorption for the apodizing mask. The mask absorption divided by the unapodized case should yield an approximate value resulting from Equation 11. Thus, holes 14 are placed in parent material 42 in a manner to provide the absorption values to produce the desired absorption profile. Apodizing mask 24 may be configured with holes 14 closely spaced together (FIG. 2C) when this layer is mounted to other layers of the lens. In this case, the mechanical integrity for the apodizing mask is provided by the layers to which the apodizing mask is mounted, thereby enabling the closely spaced arrangement of holes 14.

The apodizing mask is simple to manufacture through the use of computer-aided fabrication techniques as described above. Equation 11 may be modified to accommodate feeds that do not produce energy distributions with a Gaussian profile and achieve the desired results.

Figure 5:
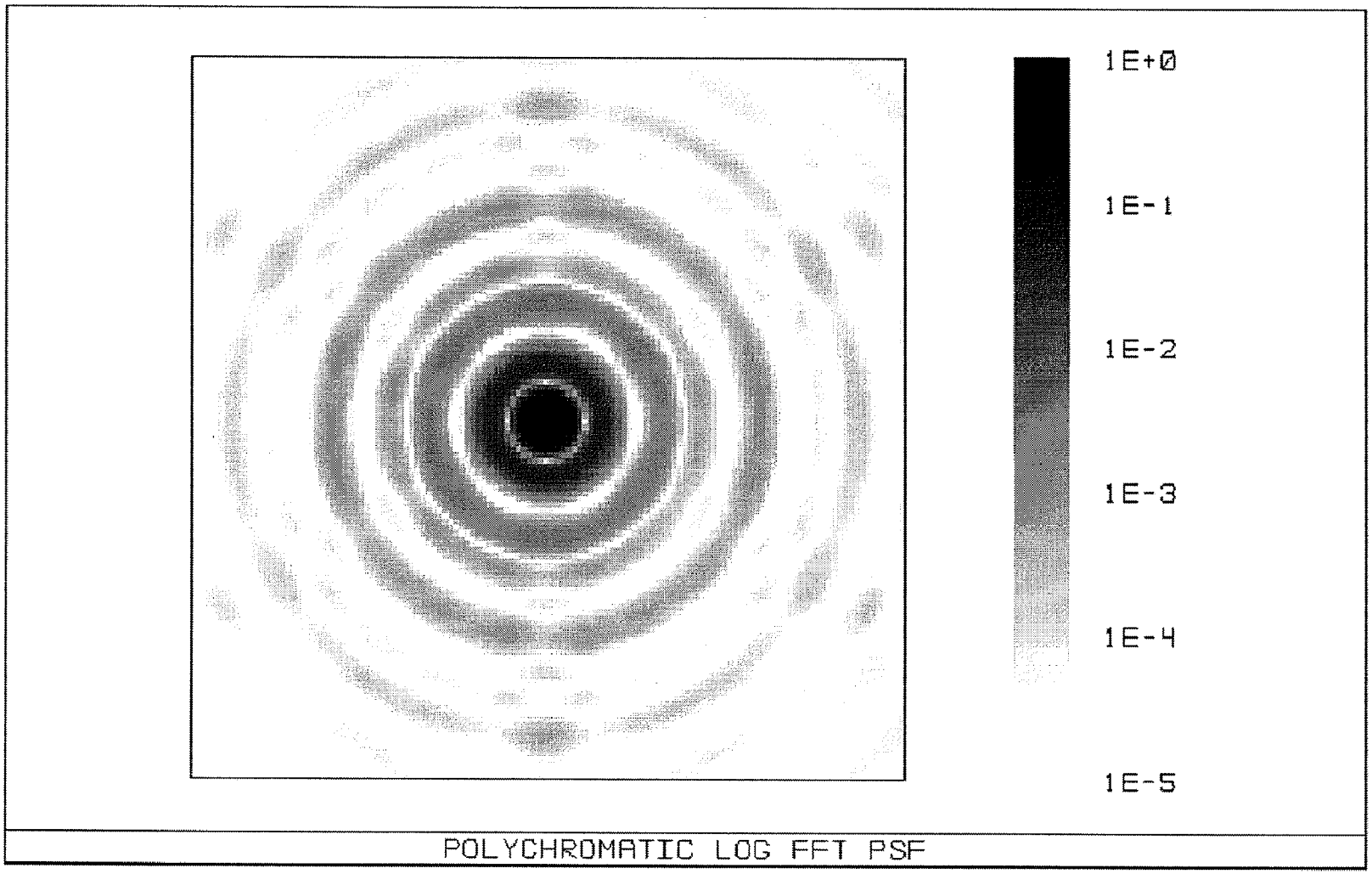
FIG. 5 is a graphical illustration of a far-field intensity pattern generated by a conventional dish antenna.
Figure 6:
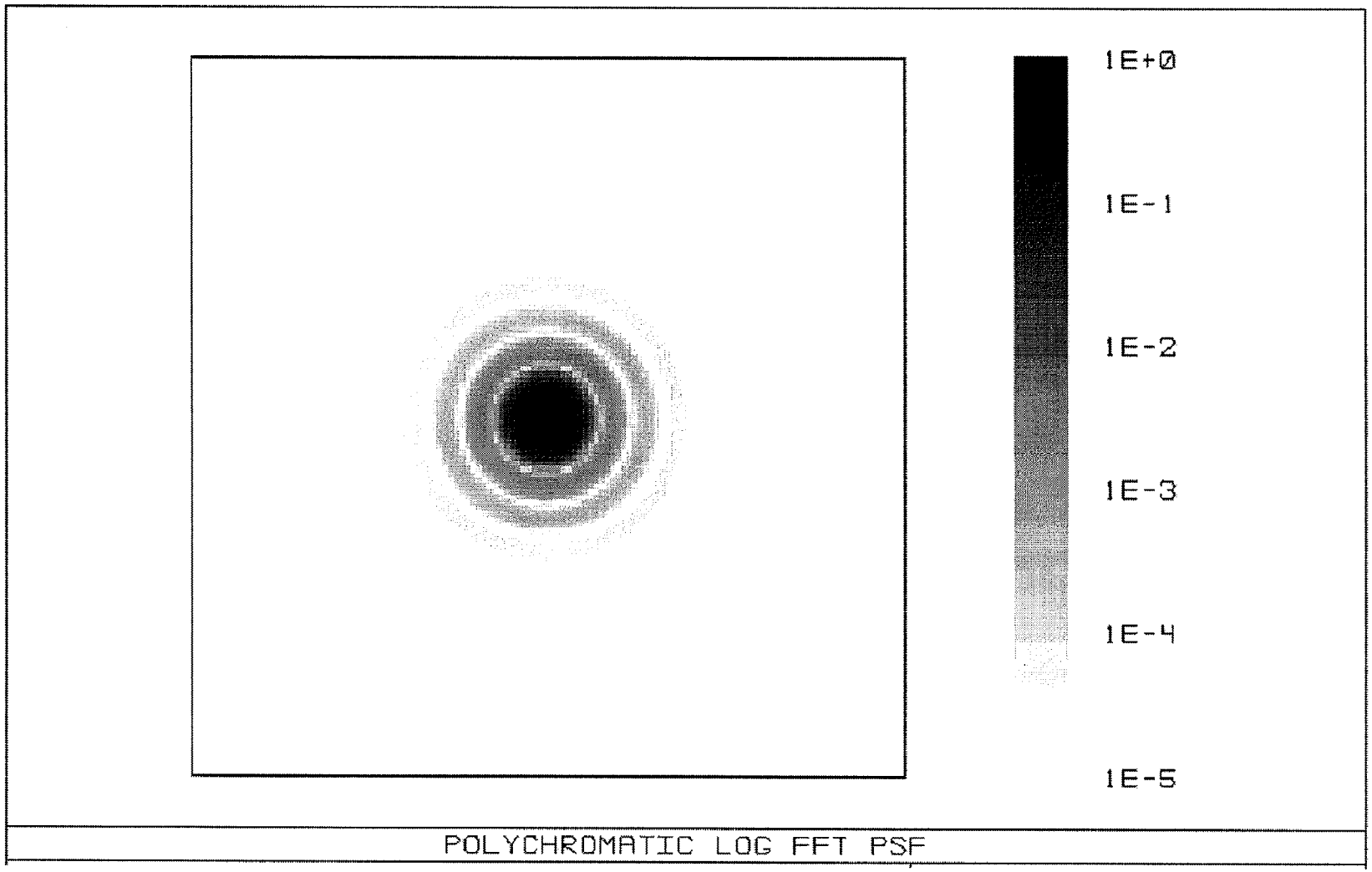
FIG. 6 is a graphical illustration of a far-field intensity pattern generated by the lens of a present invention embodiment.
Figure 7:
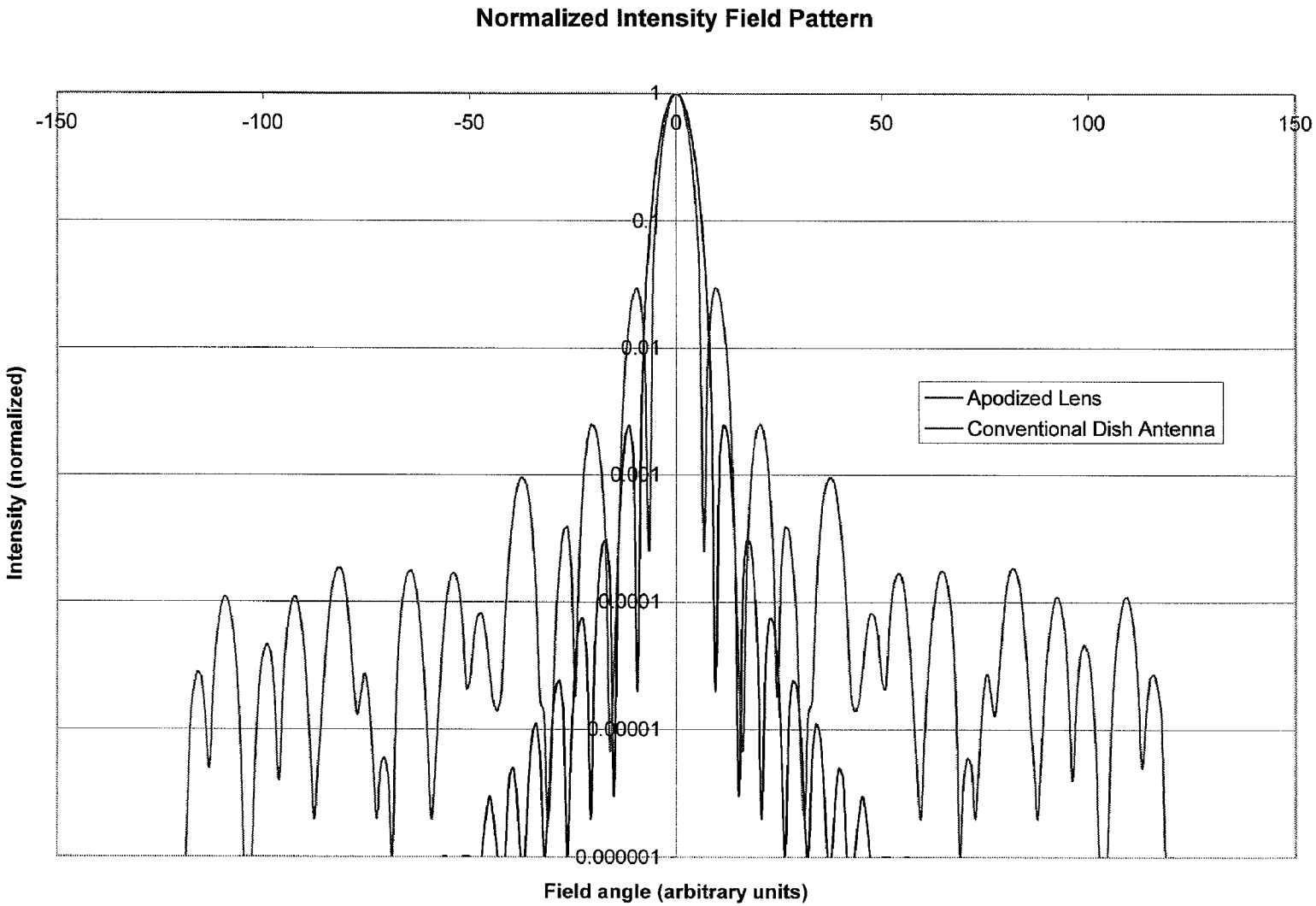
FIG. 7 is a graphical illustration of a cross-sectional profile of the far-field intensity patterns of FIGS. 5-6.

FIGS. 5-6 illustrate an exemplary far-field intensity pattern of an unapodized aperture and an apodized aperture of lens 20, respectively. The intensity magnitudes within the pattern are indicated by the shading illustrated in the key (e.g., as viewed in FIGS. 5-6). The unapodized case (FIG. 5) is for a conventional dish antenna illuminated by a feed horn and with a 20% illumination cut-off at the edge. The feed horn is prime-mounted and supported by a three-vane spider support. The apodized case (FIG. 6) shows the far-field pattern for lens 20 (e.g., an unobstructed aperture photonic crystal lens manufactured to deliver diffraction-limited beam divergence). FIG. 7 illustrates the cross-section far field intensity pattern for the unapodized and apodized cases. The intensity patterns are graphically plotted along X and Y axes respectively representing the field angle and normalized intensity (as viewed in FIG. 7). The apodized case has a slightly larger main-beam divergence, but greatly suppressed side-lobes, especially far from the main beam. Side-lobe suppression reaches factors of approximately 1,000 where the side-lobe energy is strongest.

Figure 8:
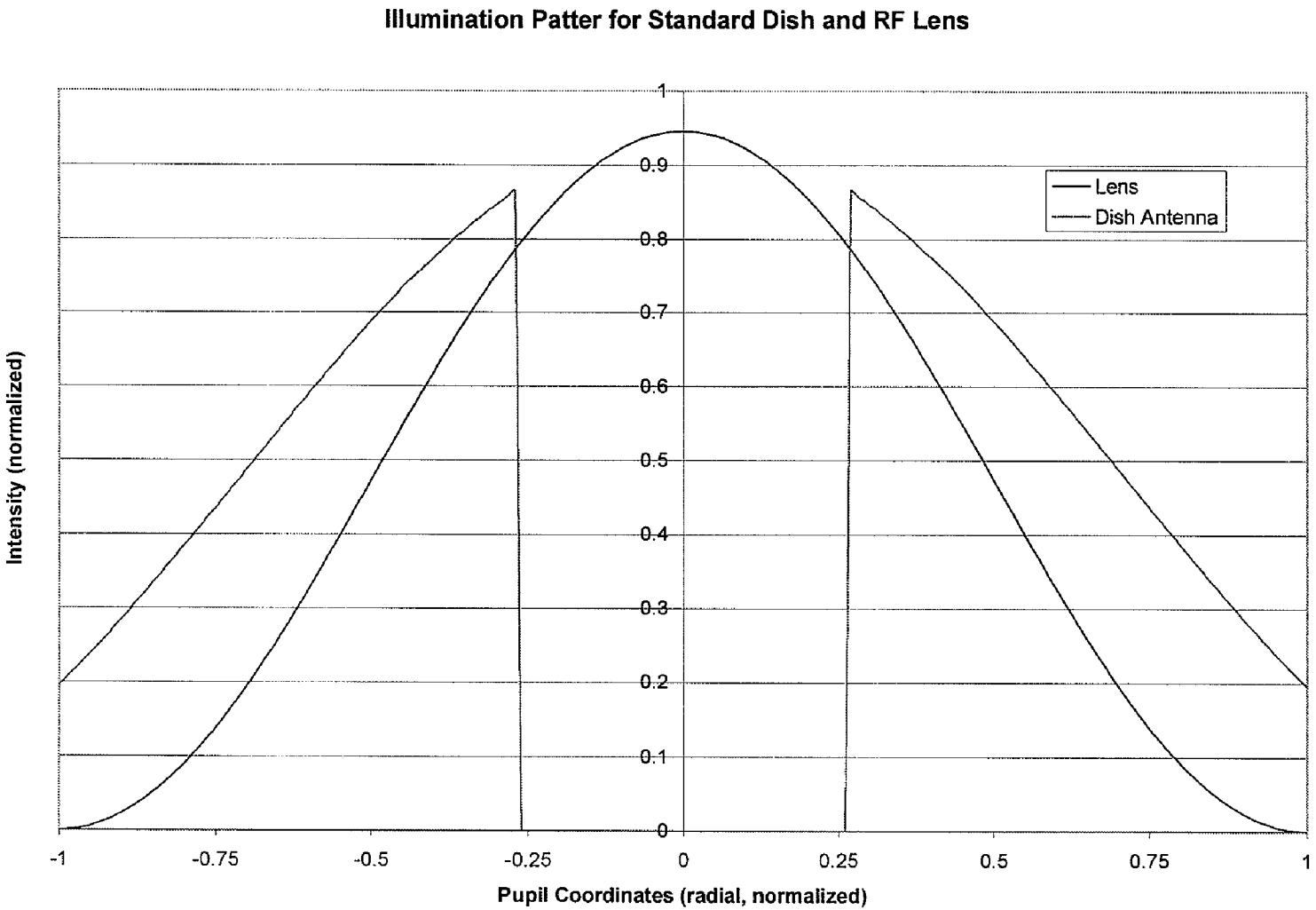
FIG. 8 is a graphical illustration of apodization profiles of a beam along Cartesian (e.g., X and Y) axes of a conventional dish antenna aperture and of a lens of a present invention embodiment.
Figure 9:
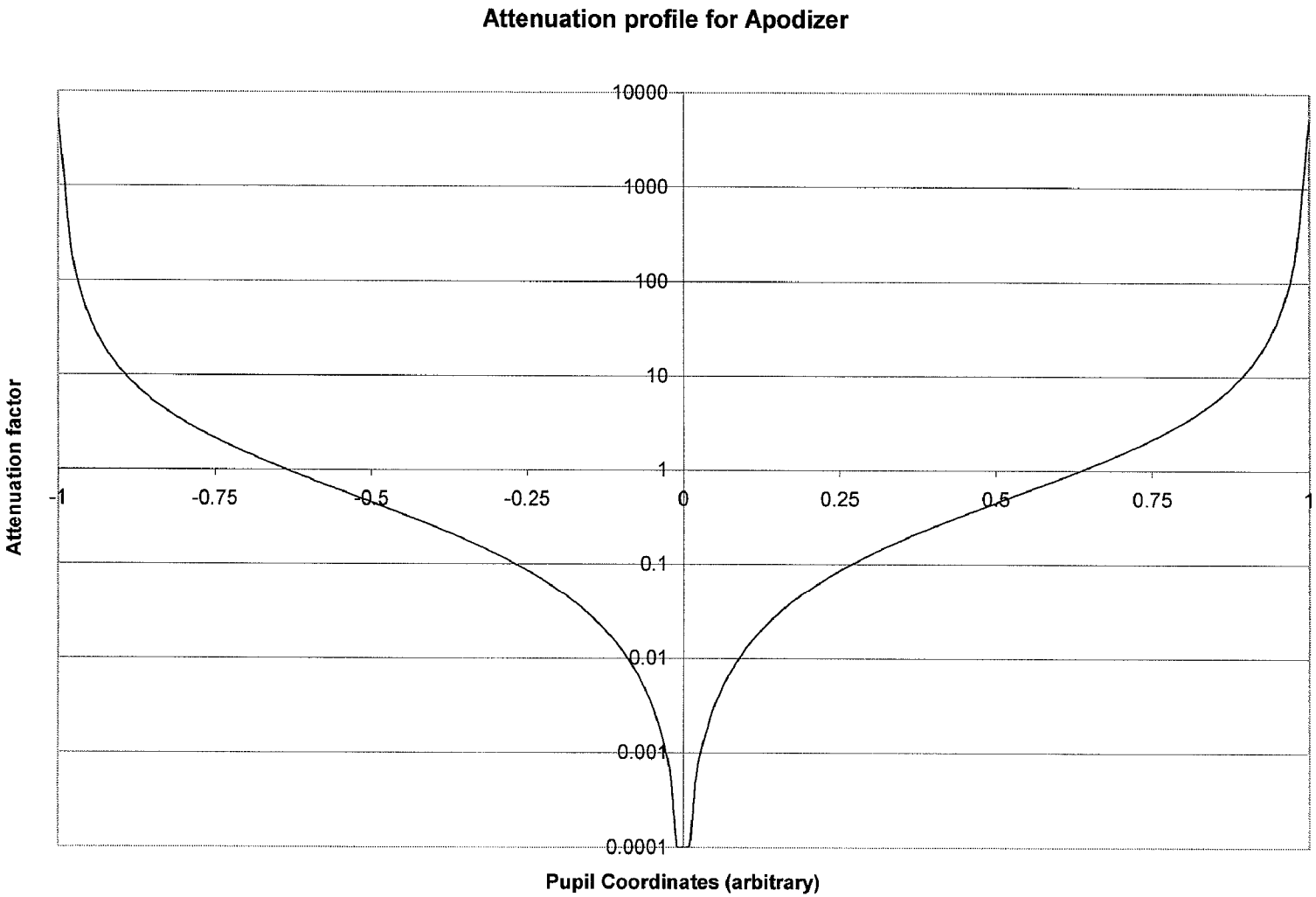
FIG. 9 is a graphical illustration of the apodization attenuation factor required to achieve an aperture illumination function.

FIG. 8 illustrates apodization or absorption profiles of the RF beam along Cartesian (e.g., X and Y) axes of a conventional dish antenna aperture and of the aperture of lens 20. The illumination patterns are graphically plotted along X and Y axes respectively representing the pupil coordinates (e.g., radial normalized coordinates) and normalized intensity (e.g., as viewed in FIG. 8). The conventional dish antenna absorption or illumination pattern is truncated, while lens 20 provides the sine-squared absorption function or illumination pattern described above. FIG. 9 illustrates the apodization attenuation factor required to attain the aperture illumination function, assuming a Gaussian beam profile truncated at approximately 20% at the aperture edge (e.g., as shown in FIG. 8 for the conventional dish antenna). The attenuation profile is graphically plotted along X and Y axes respectively representing the pupil coordinates (e.g., normalized based on the radius) and attenuation factor (e.g., as viewed in FIG. 9).

Lens 20 may be utilized to create virtually any type of desired beam steering or pattern. Thus, several lenses may be produced each with a different hole pattern to provide a series of interchangeable lenses for an RF system (FIG. 1). In this case, a photonic crystal lens may easily be replaced within an RF system with other lenses including different hole patterns to attain desired (and different) beam patterns. Further, the photonic crystal structure may be configured to create any types of devices (e.g., quasi-optical, lenses, prisms, beam splitters, filters, polarizers, etc.) in substantially the same manner described above by simply adjusting the hole dimensions, geometries and/or arrangements within a parent dielectric material to attain the desired beam steering and/or beam forming characteristics.

It will be appreciated that the embodiments described above and illustrated in the drawings represent only a few of the many ways of implementing a radio frequency lens and method of suppressing side-lobes.

The lens may include any quantity of layers arranged in any suitable fashion. The layers may be of any shape, size or thickness and may include any suitable materials. The lens may be utilized for signals in any desired frequency range. The lens layer may be of any quantity, size or shape, and may be constructed of any suitable materials. Any suitable materials of any quantity may be utilized to provide the varying dielectric constants (e.g., a plurality of solid materials, solid materials in combination with air or other fluid, etc.). The lens layer may be utilized with or without an impedance matching layer and/or apodizing mask. The lens layer parent and/or other materials may be of any quantity, size, shape or thickness, may be any suitable materials (e.g., plastics, a high density polyethylene, RF laminate, glass, etc.) and may include any suitable dielectric constant for an application. The parent material preferably includes a low loss tangent at the frequency range of interest. The lens layer may be configured (or include several layers that are configured) to provide any desired steering effect or angle of refraction or to emulate any properties of a corresponding material or optical lens. The lens layer may further be configured to include any combination of beam forming (e.g., lens) and/or beam steering (e.g., prism) characteristics.

The holes for the lens layer may be of any quantity, size or shape, and may be defined in the parent and/or other material in any arrangement, orientation or location to provide the desired characteristics (e.g., beam steering effect, index of refraction, dielectric constant, etc.). The various regions of the lens layer parent material may include any desired hole arrangement and may be defined at any suitable locations on that material to provide the desired characteristics. The holes may be defined within the parent and/or other material via any conventional or other manufacturing techniques or machines (e.g., computer-aided fabrication techniques, stereolithography, two-dimensional machines, water jet cutting, laser cutting, etc.). Alternatively, the lens layer may include or utilize other solid materials or fluids to provide the varying dielectric constants.

The impedance matching layer may be of any quantity, size or shape, and may be constructed of any suitable materials. Any suitable materials of any quantity may be utilized to provide the varying dielectric constants (e.g., a plurality of solid materials, solid materials in combination with air or other fluid, etc.). The parent and/or other materials of the impedance matching layer may be of any quantity, size, shape or thickness, may be any suitable materials (e.g., plastics, a high density polyethylene, RF laminate, glass, etc.) and may include any suitable dielectric constant for an application. The parent material preferably includes a low loss tangent at the frequency range of interest. The impedance matching layer may be configured (or include several layers that are configured) to provide impedance matching for any desired layer of the lens.

The holes for the impedance matching layer may be of any quantity, size or shape, and may be defined in the parent and/or other material in any arrangement, orientation or location to provide the desired characteristics (e.g., impedance matching, index of refraction, dielectric constant, etc.). The holes may be defined within the parent and/or other material via any conventional or other manufacturing techniques or machines (e.g., computer-aided fabrication techniques, stereolithography, two-dimensional machines, water jet cutting, laser cutting, etc.). Alternatively, the impedance matching layer may include or utilize other solid materials or fluids to provide the varying dielectric constants.

The apodizing mask may be of any quantity, size or shape, and may be constructed of any suitable materials. Any suitable materials of any quantity may be utilized to provide the desired absorption coefficient or absorption profile (e.g., a plurality of solid materials, solid materials in combination with air or other fluid, etc.). The parent and/or other material of the apodizing mask may be of any quantity, size, shape or thickness, may be any suitable materials (e.g., plastics, a high density polyethylene, RF laminate, carbon loaded material, etc.) and may include any suitable radio or other wave absorption characteristics for an application. The parent material is preferably implemented by a material highly absorptive to radio waves. The apodizing mask may be configured (or include several layers that are configured) to provide the desired absorption profile.

The holes for the apodizing mask may be of any quantity, size or shape, and may be defined in the parent and/or other material in any arrangement, orientation or location to provide the desired characteristics (e.g., side-lobe suppression, absorption, etc.). The holes may be defined within the parent and/or other material via any conventional or other manufacturing techniques or machines (e.g., computer-aided fabrication techniques, stereolithography, two-dimensional machines, water jet cutting, laser cutting, etc.). Alternatively, the apodizing mask may include or utilize other solid materials or fluids to provide the absorption properties. The apodizing mask may be configured to provide the desired absorbing properties for any suitable taper functions.

The layers of the lens (e.g., lens layer, impedance matching, apodizing mask, etc.) may be attached in any fashion via any conventional or other techniques (e.g., adhesives, etc.). The lens may be utilized in combination with any suitable signal source (e.g., feed horn, antenna, etc.), or signal receiver to steer incoming signals. The lens may be utilized to create virtually any type of desired beam pattern, where several lenses may be produced each with a different hole pattern to provide a series of interchangeable lenses to provide various beams for RF or other systems. Further, the photonic crystal structure of the lens may be utilized to create any beam manipulating device (e.g., prism, beam splitters, filters, polarizers, etc.) by simply adjusting the hole dimensions, geometries and/or arrangement within the parent and/or other materials to attain the desired beam steering and/or beam forming characteristics.

It is to be understood that the terms "top", "bottom", "front", "rear", "side", "height", "length", "width", "upper", "lower", "thickness", "vertical", "horizontal" and the like are used herein merely to describe points of reference and do not limit the present invention embodiments to any particular orientation or configuration.

From the foregoing description, it will be appreciated that the invention makes available a novel radio frequency lens and method of suppressing side-lobes, wherein a radio frequency (RF) lens includes a photonic crystal structure and suppresses side-lobe features.

Having described preferred embodiments of a new and improved radio frequency lens and method of suppressing side-lobes, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A beam manipulating device to manipulate a radio frequency (RF) beam comprising:

a refraction layer to refract an incident RF beam at a desired angle, wherein said refraction layer includes a first photonic crystal structure with a first parent material including a first dielectric constant varied across said first parent material to produce an electromagnetic field to refract said incident RF beam; and at least one impedance matching layer to impedance match said refraction layer, wherein said at least one impedance matching layer includes a second photonic crystal structure with a second parent material including a second dielectric constant varied across said second parent material in proportion to said first dielectric constant of said first parent material to impedance match said refraction layer and minimize surface reflections.

2. The device of claim 1, further including:

an absorbing mask layer to absorb extraneous energy and suppress emission of side-lobes from said incident RF beam.

3. The device of claim 2, wherein said device includes at least one of a lens and a prism.

4. The device of claim 1, wherein said first photonic crystal structure includes:

a first series of holes defined in said first parent material in a manner to vary said first dielectric constant across said first parent material to refract said incident RF beam at said desired angle.

5. The device of claim 2, wherein said device includes a pair of said impedance matching layers surrounding said refraction layer.

6. The device of claim 5, wherein said absorbing mask layer is attached to an impedance matching layer facing said incident RF beam.

7. A beam manipulating device to manipulate a radio frequency (RF) beam comprising:

a refraction layer to refract an incident RF beam at a desired angle, wherein said refraction layer includes a first photonic crystal structure that produces an electromagnetic field to refract said incident RF beam, wherein said first photonic crystal structure includes:

a first parent material including a first dielectric constant; and a first series of holes defined in said first parent material in a manner to vary said dielectric constant across said first parent material to produce said electromagnetic field for refracting said incident RF beam at said desired angle; and at least one impedance matching layer to impedance match said refraction layer, wherein at least one impedance matching layer includes a second photonic crystal structure including:

a second parent material including a second dielectric constant; and a second series of holes defined in said second parent material in a manner to vary said dielectric constant across said second parent material in proportion to said first dielectric constant of said first parent material to impedance match said refraction layer.

8. A beam manipulating device to manipulate a radio frequency (RF) beam comprising:

a refraction layer to refract an incident RF beam at a desired angle, wherein said refraction layer includes a first photonic crystal structure that produces an electromagnetic field to refract said incident RF beam;

at least one impedance matching layer to impedance match said refraction layer; and an absorbing mask layer to absorb extraneous energy and suppress emission of side-lobes from said incident RF beam, wherein said absorbing mask layer includes a photonic crystal structure including:

a parent material including an absorbing property; and a series of holes defined in said parent material in a manner to vary said absorbing property across said parent material to provide a desired absorption profile and reduce said side-lobes from said incident RF beam.

9. In a beam manipulating device including a refraction layer and at least one impedance matching layer, a method of manipulating a radio frequency (RF) beam comprising:

(a) refracting an incident RF beam at a desired angle by producing an electromagnetic field via a first photonic crystal structure within said refraction layer, wherein said first photonic crystal structure includes a first parent material including a first dielectric constant varied across said first parent material to produce said electromagnetic field to refract said incident RF beam; and (b) impedance matching said refraction layer via said at least one impedance matching layer, wherein said at least one impedance matching layer includes a second photonic crystal structure with a second parent material including a second dielectric constant varied across said second parent material in proportion to said first dielectric constant of said first parent material to impedance match said refraction layer and minimize surface reflections.

10. The method of claim 9, wherein said beam manipulating device further includes an absorbing mask and said method further includes:

(c) absorbing extraneous energy and suppressing emission of side-lobes from said incident RF beam via said absorbing mask.

11. The method of claim 10, wherein said beam manipulating device includes at least one of a lens and a prism.

12. The method of claim 9, wherein step (a) further includes:

(a.1) defining a first series of holes within said first parent material in a manner to vary said first dielectric constant across said first parent material to refract said incident RF beam at said desired angle.

13. The method of claim 10, wherein said beam manipulating device includes a pair of said impedance matching layers, and step (b) further includes:

(b.1) surrounding said refraction layer with said pair of said impedance matching layers.

14. The method of claim 13, wherein step (c) further includes:

(c.1) attaching said absorbing mask to an impedance matching layer facing said incident RF beam.

15. In a beam manipulating device including a refraction layer and at least one impedance matching layer, a method of manipulating a radio frequency (RF) beam comprising:

(a) refracting an incident RF beam at a desired angle by producing an electromagnetic field via a first photonic crystal structure within said refraction layer, wherein said first photonic crystal structure includes a first parent material with a first dielectric constant, and step (a) further includes:

(a.1) defining a first series of holes within said first parent material in a manner to vary said dielectric constant across said first parent material to produce said electromagnetic field for refracting said incident RF beam at said desired angle; and (b) impedance matching said refraction layer via at least one impedance matching layer, wherein at least one impedance matching layer includes a second photonic crystal structure including a second parent material with a second dielectric constant, and step (b) further includes:

(b.1) defining a second series of holes within said second parent material in a manner to vary said second dielectric constant across said second parent material in proportion to said first dielectric constant of said first parent material to impedance match said refraction layer.

16. In a beam manipulating device including a refraction layer, at least one impedance matching layer and an absorbing mask, a method of manipulating a radio frequency (RF) beam comprising:

(a) refracting an incident RF beam at a desired angle by producing an electromagnetic field via a first photonic crystal structure within said refraction layer;

(b) impedance matching said refraction layer via at least one impedance matching layer; and (c) absorbing extraneous energy and suppressing emission of side-lobes from said incident RF beam via said absorbing mask, wherein said absorbing mask includes a photonic crystal structure including a parent material with an absorbing property, and step (c) further includes:

(c.1) defining a series of holes within said parent material in a manner to vary said absorbing property across said parent material to provide a desired absorption profile and reduce said side-lobes from said incident RF beam.

17. A system for manipulating a radio frequency (RF) beam comprising:

a signal source providing an RF beam;

a beam manipulating device to refract said RF beam at a desired angle, wherein said beam manipulating device includes:

a refraction layer including a first photonic crystal structure with a first parent material including a first dielectric constant varied across said first parent material to produce an electromagnetic field to refract said RF beam; and at least one impedance matching layer to impedance match said refraction layer, wherein said at least one impedance matching layer includes a second photonic crystal structure with a second parent material including a second dielectric constant varied across said second parent material in proportion to said first dielectric constant of said first parent material to impedance match said refraction layer and minimize surface reflections.

18. The system of claim 17, wherein said beam manipulating device includes:

an absorbing mask layer to absorb extraneous energy and suppress emission of side-lobes from said RF beam.

19. The system of claim 18, wherein said first photonic crystal structure includes:

a first series of holes defined in said first parent material in a manner to vary said first dielectric constant across said first parent material to refract said RF beam at said desired angle.

20. The system of claim 17 further including:

a plurality of said beam manipulating devices each including a corresponding photonic crystal structure configured to refract said RF beam at a different angle and provide a different RF beam pattern, wherein said plurality of beam manipulating devices are interchangeable within said system to provide said differing beam patterns.

21. A system for manipulating a radio frequency (RF) beam comprising:

a signal source providing an RF beam;

a beam manipulating device to refract said RF beam at a desired angle, wherein said beam manipulating device includes a refraction layer including a first photonic crystal structure that produces an electromagnetic field to refract said RF beam, wherein said first photonic crystal structure includes:

a first parent material including a first dielectric constant; and a first series of holes defined in said first parent material in a manner to vary said first dielectric constant across said first parent material to produce said electromagnetic field for refracting said RF beam at said desired angle;

at least one impedance matching layer to impedance match said refraction layer, wherein at least one impedance matching layer includes a second photonic crystal structure including:

a second parent material including a second dielectric constant; and a second series of holes defined in said second parent material in a manner to vary said second dielectric constant across said second parent material in proportion to said first dielectric constant of said first parent material to impedance match said refraction layer; and an absorbing mask layer to absorb extraneous energy and suppress emission of side-lobes from said RF beam.

22. The system of claim 21, wherein said absorbing mask layer includes a third photonic crystal structure including:

a third parent material including an absorbing property; and a third series of holes defined in said third parent material in a manner to vary said absorbing property across said third parent material to provide a desired absorption profile and reduce said side-lobes from said RF beam.

23. In a system for manipulating a radio frequency (RF) beam including a signal source and a beam manipulating device including a refraction layer and at least one impedance matching layer, a method of manipulating said RF beam comprising:

(a) providing an RF beam from said signal source; and (b) refracting said RF beam at a desired angle by producing an electromagnetic field via a first photonic crystal structure within said refraction layer and impedance matching said refraction layer via said at least one impedance matching layer, wherein said first photonic crystal structure includes a first parent material including a first dielectric constant varied across said first parent material to produce said electromagnetic field to refract said RF beam, and wherein said at least one impedance matching layer includes a second photonic crystal structure with a second parent material including a second dielectric constant varied across said second parent material in proportion to said first dielectric constant of said first parent material to impedance match said refraction layer and minimize surface reflections.

24. The method of claim 23, wherein said system further includes a plurality of said beam manipulating devices each including a corresponding photonic crystal structure configured to refract said RF beam at a different angle and provide a different RF beam pattern, and step (b) further includes:

(b.1) interchanging said beam manipulating devices within said system to provide said differing beam patterns.

25. In a system for manipulating a radio frequency (RF) beam including a signal source and a beam manipulating device, wherein said beam manipulating device includes a refraction layer including a first photonic crystal structure, at least one impedance matching layer and an absorbing mask, a method of manipulating said RF beam comprising:

(a) providing an RF beam from said signal source; and (b) refracting said RF beam at a desired angle by producing an electromagnetic field via said first photonic crystal structure within said beam manipulating device, wherein step (b) further includes:

(b.1) refracting said RF beam via said refraction layer;

(b.2) impedance matching said refraction layer via said at least one impedance matching layer; and (b.3) absorbing extraneous energy and suppressing emission of side-lobes from said RF beam via said absorbing mask.

26. The method of claim 25, wherein said first photonic crystal structure includes a first parent material with a first dielectric constant, and step (b.1) further includes:

(b.1.1) defining a first series of holes within said first parent material in a manner to vary said first dielectric constant across said first parent material to produce said electromagnetic field for refracting said RF beam at said desired angle.

27. The method of claim 26, wherein at least one impedance matching layer includes a second photonic crystal structure including a second parent material with a second dielectric constant, and step (b.2) further includes:

(b.2.1) defining a second series of holes within said second parent material in a manner to vary said second dielectric constant across said second parent material in proportion to said first dielectric constant of said first parent material to impedance match said refraction layer.

28. The method of claim 27, wherein said absorbing mask includes a third photonic crystal structure including a third parent material with an absorbing property, and step (b.3) further includes:

(b.3.1) defining a third series of holes within said third parent material in a manner to vary said absorbing property across said third parent material to provide a desired absorption profile and reduce said side-lobes from said RF beam.

* * * * *